United States Patent [19]

Navarro

[11] 3,994,554

[45] Nov. 30, 1976

[54] FLAT CONDUCTOR FLAT CABLE ADAPTER

[75] Inventor: John N. Navarro, Pasadena, Calif.

[73] Assignee: Thomas & Betts Corporation, Elizabeth, N.J.

[22] Filed: May 19, 1975

[21] Appl. No.: 578,982

[52] U.S. Cl. ..... 339/99 R

[51] Int. Cl.² ..... H01R 13/38

[58] Field of Search ..... 339/17, 97–99, 339/176

[56] References Cited

UNITED STATES PATENTS

| | | | |
|---|---|---|---|
| 3,444,506 | 5/1969 | Wedekind | 339/99 R |
| 3,816,818 | 6/1974 | Meier | 339/176 MF |

*Primary Examiner*—Joseph H. McGlynn
*Attorney, Agent, or Firm*—David Teschner; Jesse Woldman

[57] ABSTRACT

The invention is directed to a thin adapter member arranged to be adhered by means of a pressure-sensitive adhesive layer contained on one surface of the adapter and prior to use protected by a release layer, which adapter has disposed, along one or two rows, apertures arranged to be aligned with individual flat conductors of the cable, such that when the flat cable and adapter are inserted into a connector, the individual contacts of the connector are permitted to enter the apertures of the adapter and insure proper contact between each contact and its associated flat conductor when the connector is assembled.

3 Claims, 8 Drawing Figures

FLAT CONDUCTOR FLAT CABLE ADAPTER

CROSS-REFERENCES TO RELATED APPLICATIONS:

The electrical connectors shown and described herein are set forth in co-pending Application Serial No. 500,177, entitled "Selectively Positionable Latch Means" by Ronald S. Narozny filed Aug. 23, 1974 and assigned to the assignee of the instant invention, and now abandoned.

BACKGROUND OF THE INVENTION:

1. Field of the Invention:

The invention is useful in the proper mating of the conductors of a flat conductor flat cable with the contacts of an electrical connector to permit the interconnection of various electronic components.

2. Description of the Prior Art:

Due to the absence of any external guide to properly align the individual conductors of a flat conductor flat cable resort was had to providing an accurate spacing between the end conductors and the marginal edge of the flat cable in order that guide means in the connector itself could be used to align the flat cable. It was difficult with available techniques to insure not only proper spacing between the conductors but also proper spacing with respect to the marginal edges of the insulation. The otherwise flat cable could be made with a thicker outside jacket and scored to provide alignment. This made the cable thick and reduced its flexure and because of shifts in the cable, with respect to the jacket, the score lines were not properly aligned much of the time.

In round conductor flat cable, the insulation about the conductors was allowed to generally follow the contour of a part of the conductors such that the insulation was bowed out adjacent the conductors and recessed at the interspace between adjacent conductors giving a natural guide for alignment of the conductors with the contacts of the connector.

SUMMARY OF THE INVENTION:

The present invention overcomes the difficulties of correctly aligning the flat conductors of a flat cable with the contacts of an electrical connector without requiring the modification of either the cable or the connector. This is achieved by providing an adapter, adherable to the flat cable, having a plurality of apertures extending therethrough, one for each conductor, and aligned with such conductor used to guide the contacts of the electrical connector to provide a proper connection between each contact and its associated flat conductor. The adapter is made of insulating material and is approximately equal in width to the flat cable and of sufficient length longitudinally of the cable to permit one or two rows of apertures to be placed therein. If a single row, one aperture is provided for each flat conductor. In closely aligned conductor cables two or more rows of apertures are used, each row for prescribed conductors, i.e., using two rows, the apertures of one row are made to align with the odd conductors while the apertures in the second row are made to align with the even conductors of the cable. The adapter is adhered to the cable insulation by any convenient means such as a layer of pressure sensitive adhesive coated on one side of the adapter and protected prior to use by a release layer. It is therefore an object of this invention to provide an inexpensive, easy to use adapter and method of employing the adapter to align the flat conductors of a flat cable with mating contacts of an electrical connector.

It is another object of this invention to provide an adapter having a pressure-sensitive adhesive on one surface thereof for adhesion to the insulation of a cable.

It is another object of this invention to provide an adapter having a plurality of apertures therein to receive and guide the contacts of an electrical connector to the associated flat conductors of a flat cable.

It is still another object of this invention to provide an adapter having a plurality of apertures therein, arranged in at least two rows to receive and guide specific contacts of an electrical connector to the associated flat conductors of a flat cable.

Other objects and features of the invention will be pointed out in the following description and claims and illustrated in the accompanying drawings, which disclose, by way of example, the principles of the invention and the best mode which has been contemplated for carrying them out.

BRIEF DESCRIPTION OF THE DRAWINGS:

In the drawings in which similar elements are given similar reference characters.

Figure 1:
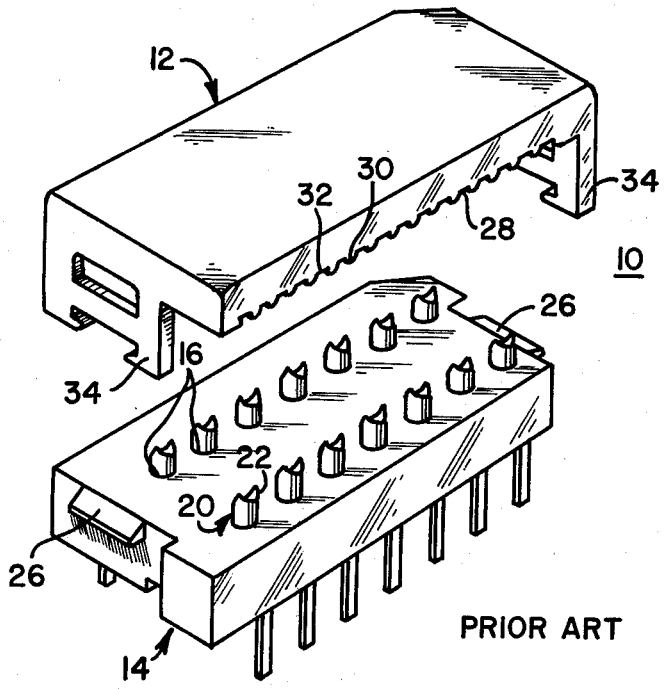
FIG. 1 is an exploded front prospective view of a connector available in the prior art and is FIG. 1 of the aforesaid Narozny application.
Figure 3:
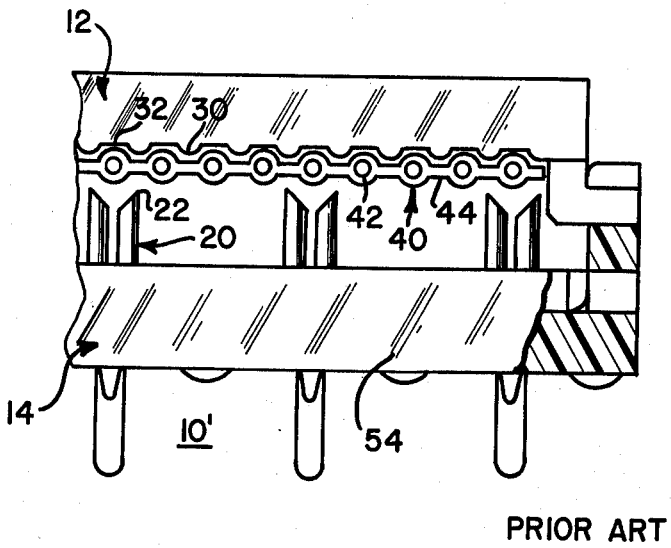
FIG. 3 is a fragmentary front elevational view, partly cut away and partly in section of a connector similar to that of FIG. 2 and cable of FIG. 2, and is FIG. 8 of the aforesaid Narozny application.
Figure 2:
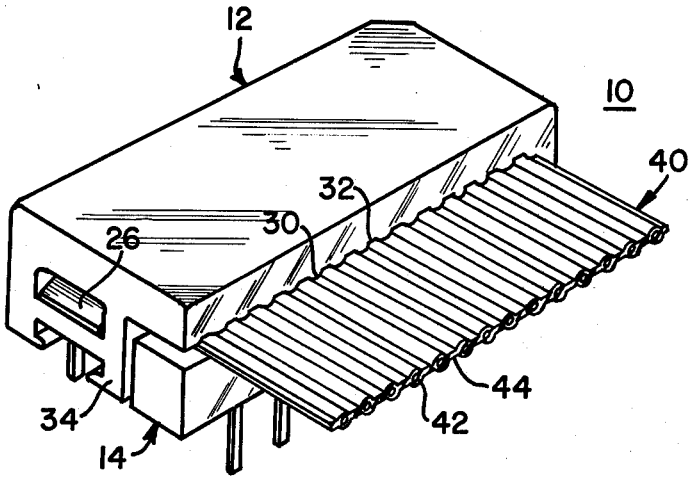
PRIOR ART FIG. 2
FIG. 2 is a front prospective view of the connector of FIG. 1 assembled to a round conductor flat cable and is FIG. 5 of the aforesaid Narozny application.

DESCRIPTION OF THE PREFERRED EMBODIMENT:

Turning now to FIGS. 1 to 3, connector 10 is made up of a top portion 12 and a base portion 14 arranged to be coupled together by latch means 34 on top portion 12 and ears 26 on base portion 14. A plurality of insulation piercing contacts 20 are arranged in two rows of apertures 16 in base portion 14. A series of protuberances 30 project into the interspace between top portion 12 and base portion 14. The protuberances 30 are spaced by recesses 32. When the connector 10 is partially assembled, as shown in FIGS. 2 and 3, a space exists between the underside of top portion 12 and the tips 22 of the contacts 20 in base portion 14. Into this interspace, a round conductor flat cable 40 is introduced. By aligning the conductors 42 with the recesses 32 and the protuberance 30 with the lands 44 between the conductors 42, the proper alignment between the conductors 42 and the contacts 20 is established. Upon a full assembly of the top portion 12 and the bottom portion 14 of the connector 10, the contacts 20 will pierce the insulation and make good electrical contact with their associated conductors 42.

Figure 4:
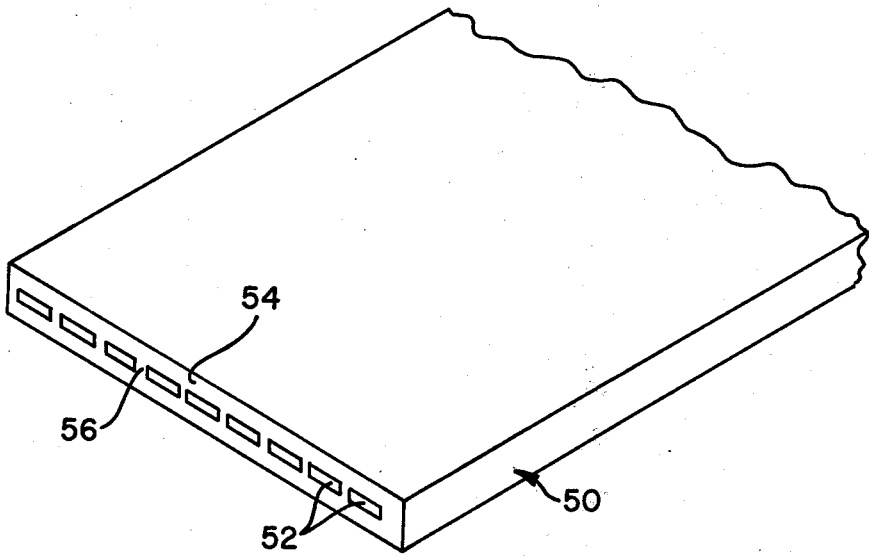
FIG. 4 is a fragmentary front prospective view of a flat conductor flat cable used with the present invention.
Figure 5:
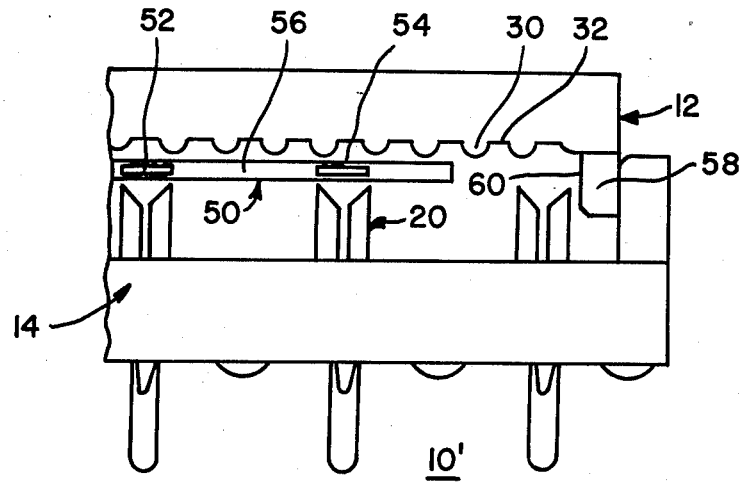
FIG. 5 is a fragmentary front elevational view showing the positioning of a cable of the type shown in FIG. 4 within a connector of the type shown in FIG. 3.

The natural provision for alignment of the round conductors 42 of a round conductor flat cable 40 is not present in a flat conductor flat cable 50, as is shown in FIG. 4. Flat cable 50 has a series of flat conductors 52 separated by insulation lands 56. The insulation 54 about the conductors 52 is also flat giving no natural break in the outer surface of the insulation 54. As a result, upon the insertion of the cable 50 into a connector 10', as is shown in FIG. 5, the proper alignment of the contacts 20 with the individual flat conductors 52 cannot be assured. If the cable 50 is wide enough to extend from the inner surface 60 of latch finger 58 on one side to the other side (not shown) and if the conductors 52 are properly spaced from each other and from the marginal edges of the cable 50, when the connector 10' is fully assembled each of the contacts 20 will mate with one associated flat conductor 52. However, because cables made by different manufacturers and connectors made by different manufacturers are not of the same size, it is possible for the cable 50 to be narrower than the connector 10' and, as a result, if the marginal edge of the cable 50 was brought against the inner surface 60 of latch finger 58, some of the flat conductors 52 of the cable 50 would be missed, some would be shorted by the contact 20 bridging two adjacent conductors 52 and some would be properly terminated.

Figure 6:
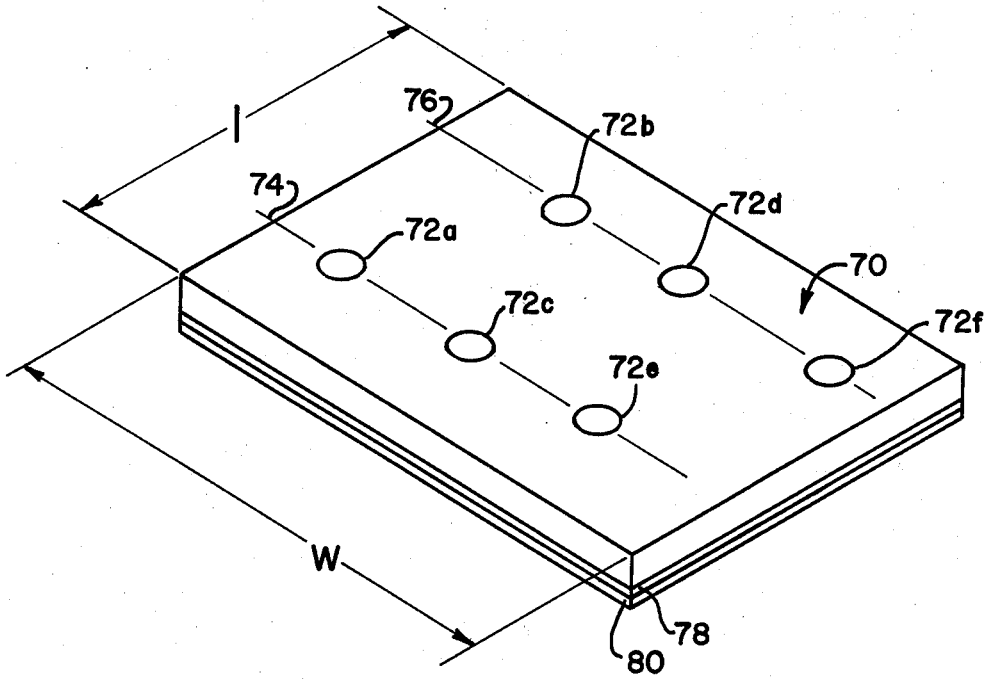
FIG. 6 is a front prospective view of an adapter constructed in accordance with the concepts of the invention.

To provide for the proper alignment of the individual flat conductors with the contacts of an electrical connector the adapter 70 of FIG. 6 is employed. Adapter 70 is made of paper, cardboard, plastic, or any other convenient insulating material. It will have a width *w* approximately equal to the width of the cable with which it is used and will have a length *l* sufficient to permit one or more rows of apertures 72 to be accommodated. The spacing between adjacent apertures 72 will be the center to center pitch of the flat conductor of the cable. Manufacturers position their contacts in connectors and their conductors in cables on a uniform pitch. However, no uniformity exists with respect to the dimensions of the marginal areas between the first and last conductors and the respective marginal edges of the cable and the first and last contacts and the adjacent surfaces of the connector body. Thus, if one is able to locate correctly the end conductor with the end contact and one does not skew the cable in the connector, all contacts should mate with their associated conductor.

Based upon the pitch of the conductors of the cable it can be determined whether the apertures 72 will extend along one or a number of rows. If the conductors are widely spaced and placing an aperture 72 at each conductor position permits a sufficient land of insulation to exist between adjacent apertures 72, a single row 74 will be used. At reduced pitch of the conductors, the apertures 72 can be arranged in two rows such that apertures 72*a*, 72*c* and 72*e* are arranged in row 74 to align with the odd numbered conductors 52*a*, 52*c* and 52*e* of the cable 50 in FIG. 7. Apertures 72*b*, 72*d* and 72*f* making up row 76 are arranged to be in alignment with the even numbered conductors 52*b*, 52*d* and 52*f* of the cable 50 in FIG. 7. For still closer spacing of the conductors, or a reduced pitch, the apertures 72 can be arranged in three or more rows.

Coated on the bottom surface of the adapter 70 is a layer 78 of pressure-sensitive adhesive of a type well known in the prior art. To protect the adhesive layer 78 and prevent premature adherence of the adapter 70 to any surface a release layer 80 is provided. Release layer 80 can be easily removed without affecting the adhesive layer 78 prior to use of the adapter 70. Although the adapter 70 has been described in terms of a pressure-sensitive adhesive, any other type of bonding could be used such as a chemically or heat-actuated adhesive, sonic welding, etc.

Figure 7:
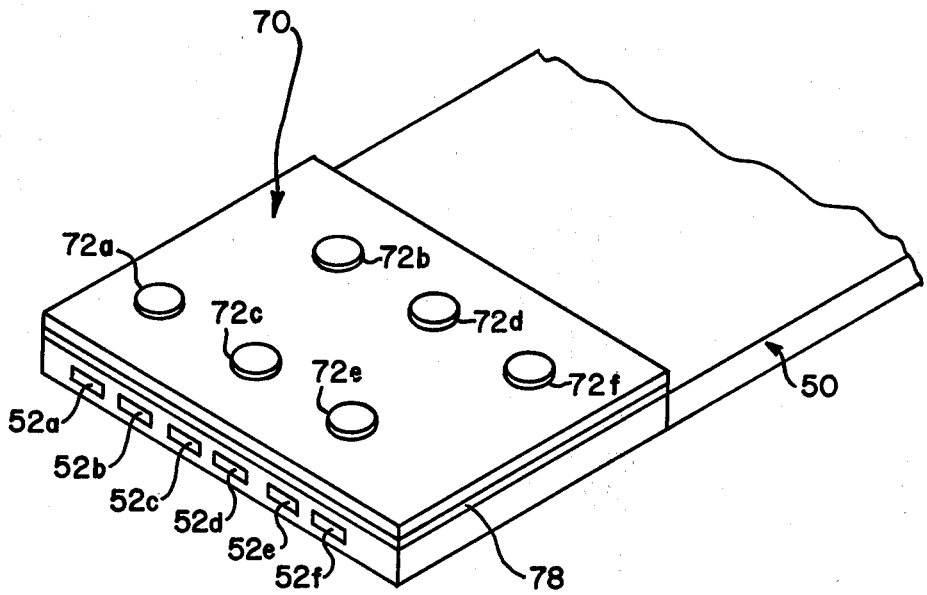
FIG. 7 is a front prospective view of a flat conductor flat cable with the adapter of FIG. 6 adhered thereto.
Figure 8:
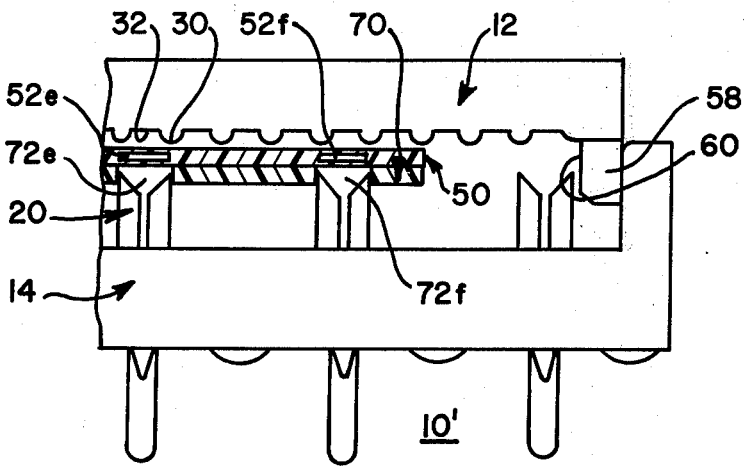
FIG. 8 is a fragmentary front elevational view, partly in section showing the engagement of the contacts of an electrical connector with the adapter apertures.

With the adapter 70 adhered to the flat cable 50 by the pressure-sensitive adhesive layer 78, as is shown in FIG. 7, the assembled flat cable 50 and adapter 70 may now be inserted into the interspace between top portion 12 and base portion 14, as is shown in FIG. 8, without reference to the inner surface 58 of latch finger 60 or the protrusions 30 and recesses 32 of top portion 12. Instead, the appropriate contact 20 is made to enter the aperture 72 so that when the top portion 12 is fully assembled to base portion 14, the contacts 20 will enter their associated flat conductor 52.

While there has been shown and described and pointed out the fundamental novel features of the invention as applied to the preferred embodiment, it will be understood that various omissions and substitutions and changes of the form and details of the devices illustrated and in its operation may be made by those skilled in the art, without departing from the spirit of the invention.

The embodiments of the invention in which an exclusive property or privilege is claimed are defined as follows:

1. An adapter for the alignment of the individual flat conductors of a flat conductor-flat cable having top and bottom flat, planar surfaces with the associated contacts of a mating connector having a base containing a plurality of electrical contacts and a top; said adapter comprising: a flat, thin plate member having the overall configuration of such mating connector base and having a first flat side and a second flat side; a plurality of apertures therein extending from said first side to said second side; a layer of pressure-sensitive adhesive on one of said first and said second sides and a release material over said layer of pressure-sensitive adhesive to prevent engagement with said pressure-sensitive adhesive; said adapter adhered to one flat, planar surface of said flat conductor-flat cable by said pressure-sensitive adhesive once said release material is removed, each of said apertures of said adapter being aligned with an associated one of said flat conductors to align and guide each of the contacts of such a connector into its associated flat conductor without reference to any external connector guide means to prevent improper mating between any contact and other than its associated flat conductor, said adapter remaining as a part of said flat cable permit same to be used with other connectors.

2. An adapter as defined in claim 1, wherein said plurality of apertures are arranged in two rows across the width of said flat cable.

3. An adapter as defined in claim 1, wherein said plurality of apertures are arranged in two rows across the width of said flat cable; the apertures of a first of said two rows being aligned with the odd numbered flat conductors of a flat cable and the apertures of the second of said two rows being aligned with the even numbered conductors of a flat cable.

* * * * *

UNITED STATES PATENT AND TRADEMARK OFFICE

CERTIFICATE OF CORRECTION

PATENT NO. : 3,994,554

DATED : November 30, 1976

INVENTOR(S) : John N. Navarro

It is certified that error appears in the above-identified patent and that said Letters Patent are hereby corrected as shown below:

Column 4, line 67, after "numbered" insert -- flat --

Signed and Sealed this

Eighth Day of February 1977

[SEAL]

*Attest:*

RUTH C. MASON
*Attesting Officer*

C. MARSHALL DANN
*Commissioner of Patents and Trademarks*